United States Patent [19]

Valks et al.

[11] 4,194,376

[45] Mar. 25, 1980

[54] LEATHER PRESS

[75] Inventors: Robert K. Valks, Wetherby; Brian W. Botham, Bradford, both of England

[73] Assignee: USM Corporation, Farmington, Conn.

[21] Appl. No.: 895,740

[22] Filed: Apr. 13, 1978

[30] Foreign Application Priority Data

Apr. 16, 1977 [GB] United Kingdom ..... 15875/77

[51] Int. Cl.[2] ..... C14B 1/30

[52] U.S. Cl. ..... 69/48

[58] Field of Search ..... 69/8, 48; 12/33, 36, 12/36.5, 36.8, 37, 38, 16.1, 16.4; 38/25, 71, 72; 68/241, 242

[56] References Cited

U.S. PATENT DOCUMENTS

| | | | |
|---|---|---|---|
| 1,332,963 | 3/1920 | Tucker et al. | 69/48 |
| 1,375,469 | 4/1921 | Richard | 69/48 |
| 1,533,115 | 4/1925 | Hulbert | 69/48 |

*Primary Examiner*—Patrick D. Lawson

*Attorney, Agent, or Firm*—Donald N. Halgren; Richard B. Megley; Vincent A. White

[57] ABSTRACT

A leather press in which two wedges are synchronously driven to raise a lower platen in the press from an open condition to a position adjacent an upper platen of the press. The lower platen is movably mounted on a support. The support and the wedges are in slidable engagement with one another to effect a preliminary closing of the press. A pressurizable expandable member such as a flexible diaphragm may be mounted between the movable platen and the support so that the platens are secondarily urged together by the application of hydraulic pressure, to apply the required working pressure, to a leather workpiece disposed between the platens. The diaphragm is preferably provided by a wall portion of an inflatable sac.

12 Claims, 5 Drawing Figures

LEATHER PRESS

BACKGROUND OF THE INVENTION

1. Field of the Invention

This invention is concerned with presses and more particularly to machines for pressing leather.

2. Prior Art

Hydraulic presses used for smoothing or embossing the surface of leather, comprise upper and lower platens between which the leather is pressed to a predetermined pressure. The upper platen is fixed and the lower platen is vertically movable between a position spaced apart from the upper platen (allowing an operator easy access to a workpiece between the platens), and a position separated from the upper platen only by the thickness of a workpiece between the two platens. Hydraulic cylinders are employed for moving the lower platen towards and away from the upper platen and for applying the required working pressure to the leather workpiece.

Two small diameter hydraulic cylinders and one large diameter hydraulic cylinder are mounted on a base of the aforementioned prior art press. The two small diameter cylinders raise the lower platen from an open condition of the press until a light clamping pressure is exerted on a workpiece between the platens. The large diameter cylinder is pressurized to exert a high load on the lower platen to press the workpiece to the required predetermined pressure. The large diameter cylinder is expensive however, and also needs a large and expensive pre-fill valve to accommodate it, to admit hydraulic fluid under pressure very quickly to the large diameter cylinder, to raise the lower platen at an acceptable speed, and hence, is a drawback associated with the prior art.

BRIEF SUMMARY OF THE INVENTION

The embodiments of the present invention comprise a fixed, heated, upper platen, a vertically movable lower platen mounted on a support (hereinafter referred to as a bolster) and press closing means operative to effect a predetermined pressure upon a leather workpiece positioned between opposed the horizontal surfaces of the platens.

The press closing means comprises two wedge members in sliding engagement with the bolster, and wedge driving means. The wedge driving means comprises a hydraulic cylinder secured to each wedge member and synchronizing means, so that the cylinders are operative to synchronously move the two wedge members towards one another to raise the bolster and the lower platen. The press closing means also comprises a distensible diaphragm mounted between the lower platen and the bolster wherein admission of hydraulic fluid under pressure between the diaphragm and the bolster permits the lower platen to be urged towards the upper platen by the diaphragm.

The first embodiment of the press also comprises two hydraulic lifting cylinders arranged to lift the bolster vertically in cooperation with the wedge members. The second embodiment of the press comprises a plurality of rollers arranged in two pairs. The rollers enable the wedge members to be driven inwardly by the wedge driving means, from the open condition of the press, without the assistance of lifting cylinders.

Advantages from the use of a diaphragm could still be realized when used in conjunction with other mechanisms than an arrangement of wedge members for raising the lower platen; thus, for example, toggle mechanisms, screw mechanisms, or hydraulic lifting cylinders, provided a sufficient lock was provided to prevent the support being depressed upon pressurization of the diaphragm. A wedge lifting mechansim similar to that of either of the embodiments of the leather presses could be employed where the pressure applying means comprised something other than a distensible diaphragm. For example, hydraulic pancake cylinders mounted in a bolster might be employed as the pressure applying means. A wedge lifting mechanism could also be usefully employed in, for example, a cutting press, where the object is to effect a cutting stroke rather than apply a predetermined pressure to a workpiece.

BRIEF DESCRIPTION OF THE DRAWINGS

The various objects and advantages of the present invention will become more apparent from the following detailed description, to be read with reference to the accompanying drawings, in which.

DESCRIPTION OF THE PREFERRED EMBODIMENTS

Figure 1:
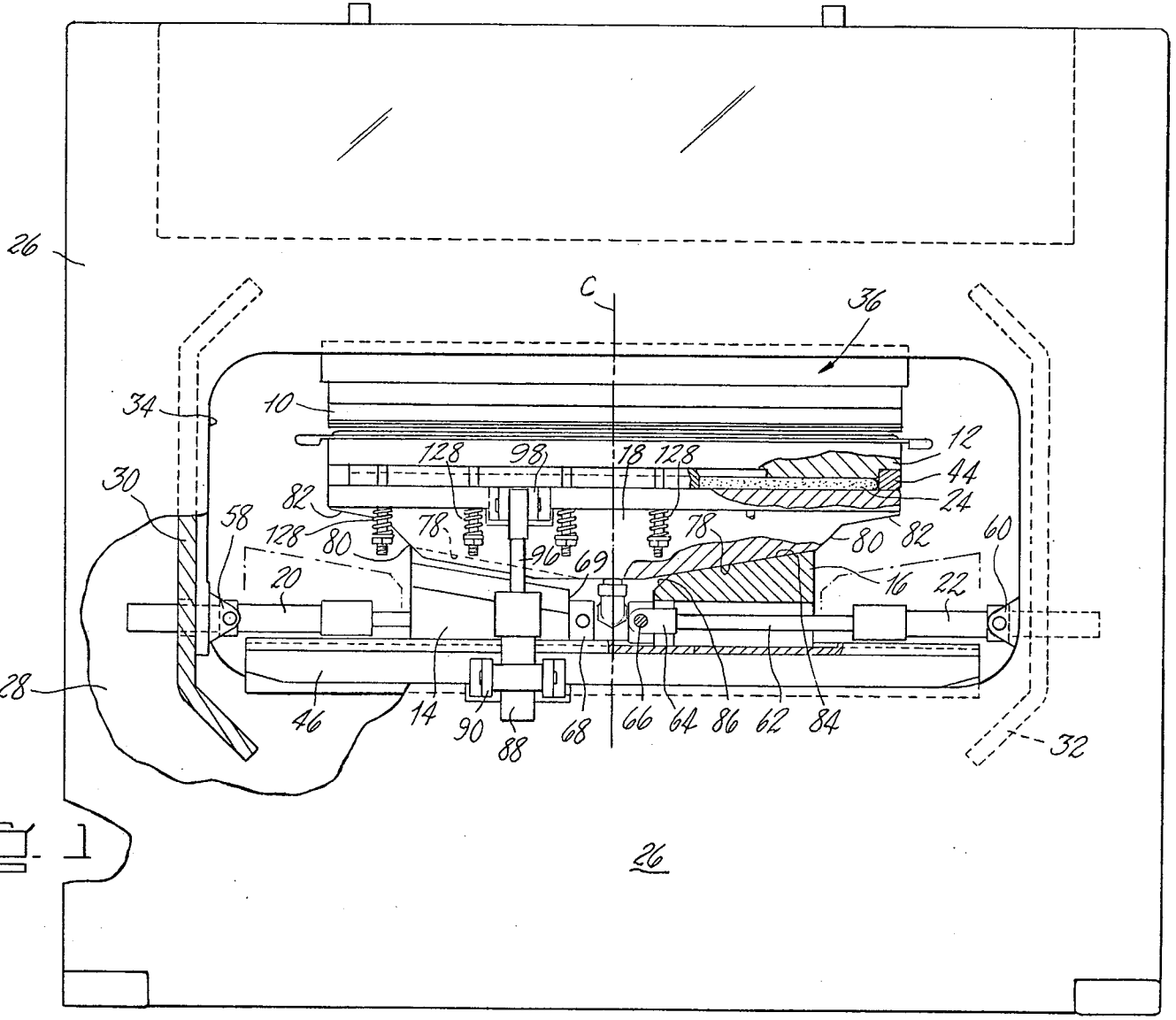
FIG. 1 is a front elevational view, partly in section, of the first embodiment of the press in a partially closed condition.

Referring to the drawings in detail, and particularly to FIG. 1, there is shown a leather press comprising an upper platen 10, a lower platen 12, and press closing means.

The press closing means comprises a pair of wedge members 14 and 16, in sliding engagement with a bolster 18. The bolster 18 provides a support on which the lower platen 12 is mounted. The press closing means includes a wedge driving arrangement wherein a pair of double-acting hydraulic cylinders, 20 and 22, supplied by a pressurized hydraulic system, synchronously move the two wedge members linearly towards one another and the centerline of the press, as indicated by C in FIG. 1, to raise the bolster 18 and the lower platen 12. The press closing means also comprises an inflatable sac 24, operable after movement of said wedge members, 14 and 16. The inflatable sac 24 comprises an upper wall portion which provides a distensible diaphragm mounted between the bolster and the lower platen. Admission of fluid under pressure into the inflatable sac 24 permits the upper and lower platens to be urged together.

Figure 2:
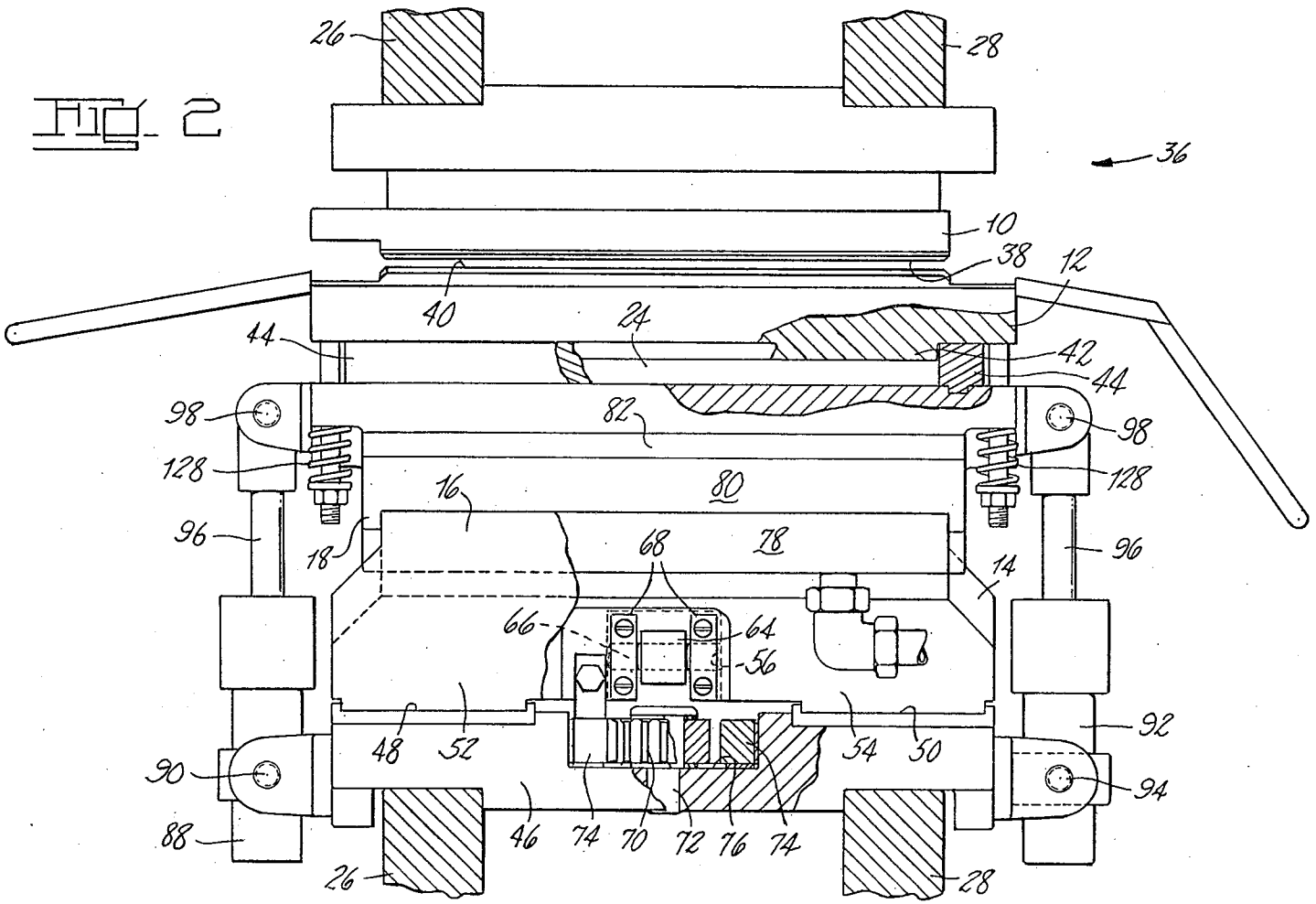
FIG. 2 is an elevational view, partly in section, from the right-hand side of the first embodiment of the press in the condition shown in FIG. 1.

As shown in FIGS. 1 and 2, the presses each comprise a rigid machine frame. The frame includes a vertical front wall 26 and a vertical rear wall 28 (parallel to the front wall). A pair of spacer plates 30 and 32, are generally vertically arranged between the front and rear walls. The front and rear walls, 26 and 28, each have a generally rectangular opening 34 disposed therein and aligned with one other. A fixed upper platen assembly 36, comprising the upper platen 10, is secured astride the front and rear walls, 26 and 28, along the top edges of the openings 34 so that the upper platen presents a horizontal downwardly facing work surface 38.

Figure 5:
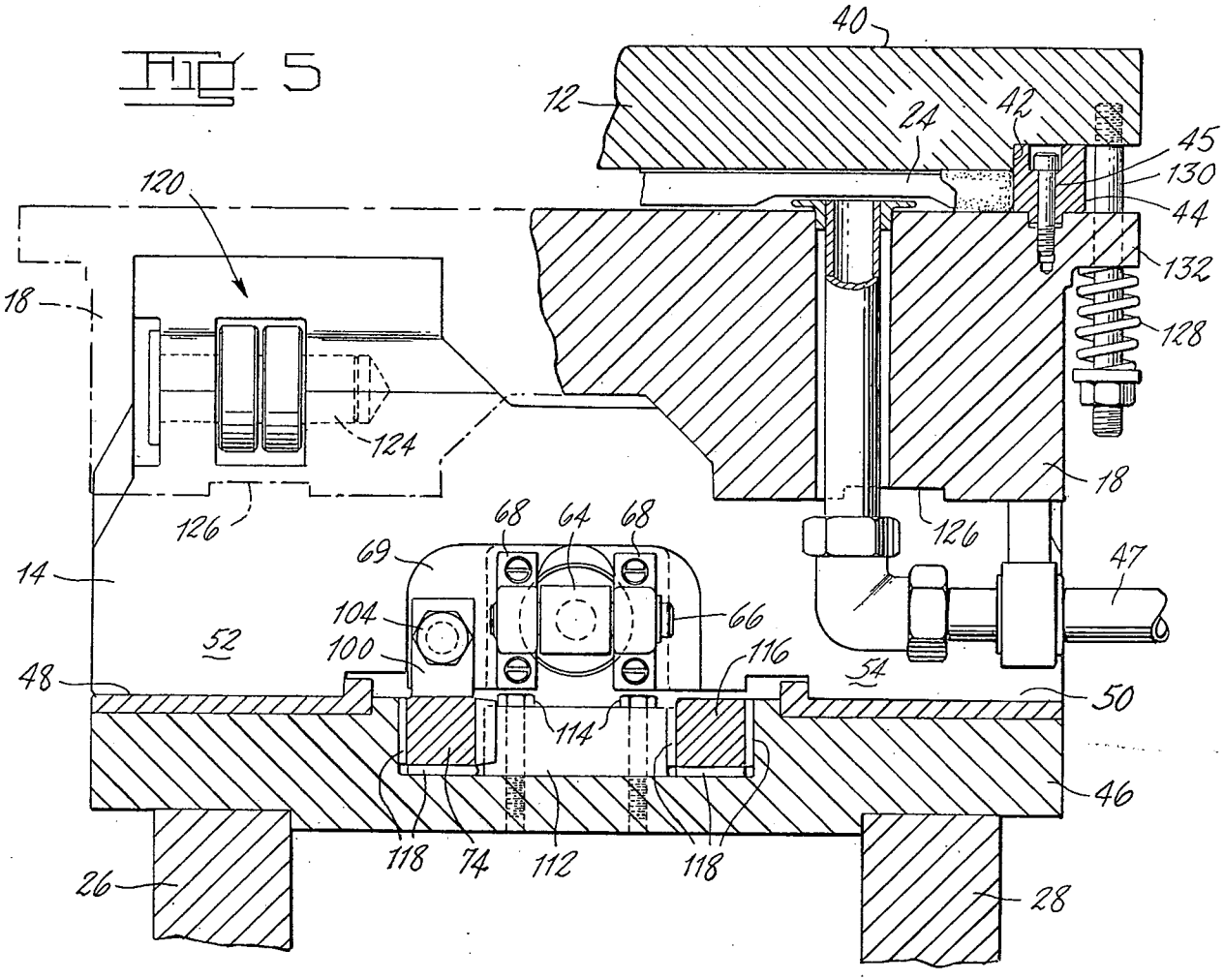
FIG. 5 is a view in elevation from the centerline of the second embodiment of the press looking in the direction of the arrow A in FIG. 4, the bolster and lower platen being partially cut away.

The lower platen 12 presents a horizontal upwardly facing work surface 40 in opposition to the downwardly facing surface 38 of the upper platen 10. The lower platen 12 comprises a rectangular boss 42 which is located in a shallow cavity on top of the bolster 18. The cavity is provided by an arrangement of four support strips 44, wherein the platen can rest on the support strips 44 and be guided thereby for small vertical movements. An array of six compression springs 128 are mounted along each side of the press, as shown in FIGS. 1, 2 and 5, and act to depress the lower platen 12 onto the support strips 44. The springs 128 are each mounted on a stud 130. Each stud 130 is secured in the lower platen and extends vertically downwards through a clearance hole in a ledge portion 132 of the bolster 18. The four support strips 44 are secured by an arrangement of bolts 45 to an upper surface of the bolster 18, as shown in FIG. 5. The inflatable sac 24 is located in the cavity bounded by the strips 44, the upper surface of the bolster 18 and the boss 42 of the lower platen 12. As also shown in FIG. 5, a pipe 47 passes through the bolster 18 to the sac 24 to permit the feeding of hydraulic fluid under pressure to the sac 24. The sac 24 may be constructed of woven nylon and neoprene rubber materials and would have to withstand an internal pressure of 1500 p.s.i. when constrained between the bolster 18 and the lower platen 12.

A base member 46 is mounted astride the front and rear walls, 26 and 28, along bottom edges of the openings 34 as shown in FIGS. 2 and 5. The base member 46 provides two parallel, upwardly, facing, horizontal, slideways for the wedge members, 14 and 16. The base member 46 permits movement of the wedge members transversely of the press, there being a front slideway 48 and a rear slideway 50. Each of the wedge members 14 and 16, comprise a front foot portion 52 and a rear foot portion 54, as shown in FIGS. 2 and 5, which stand on the front and rear slideways, respectively, bridging a tunnel 56 therebetween, as shown in FIG. 4, which tunnel 56 extends for the whole length (transversely of the press) of the two wedge members, 14 and 16.

The two wedge members, 14 and 16, are mounted to slide towards and away from each other (and the centerline C of the press) transversely of the press on the base member 46. One of the two hydraulic cylinders 20 and 22, is secured to each of the wedge members to effect their respective sliding movement.

Figure 3:
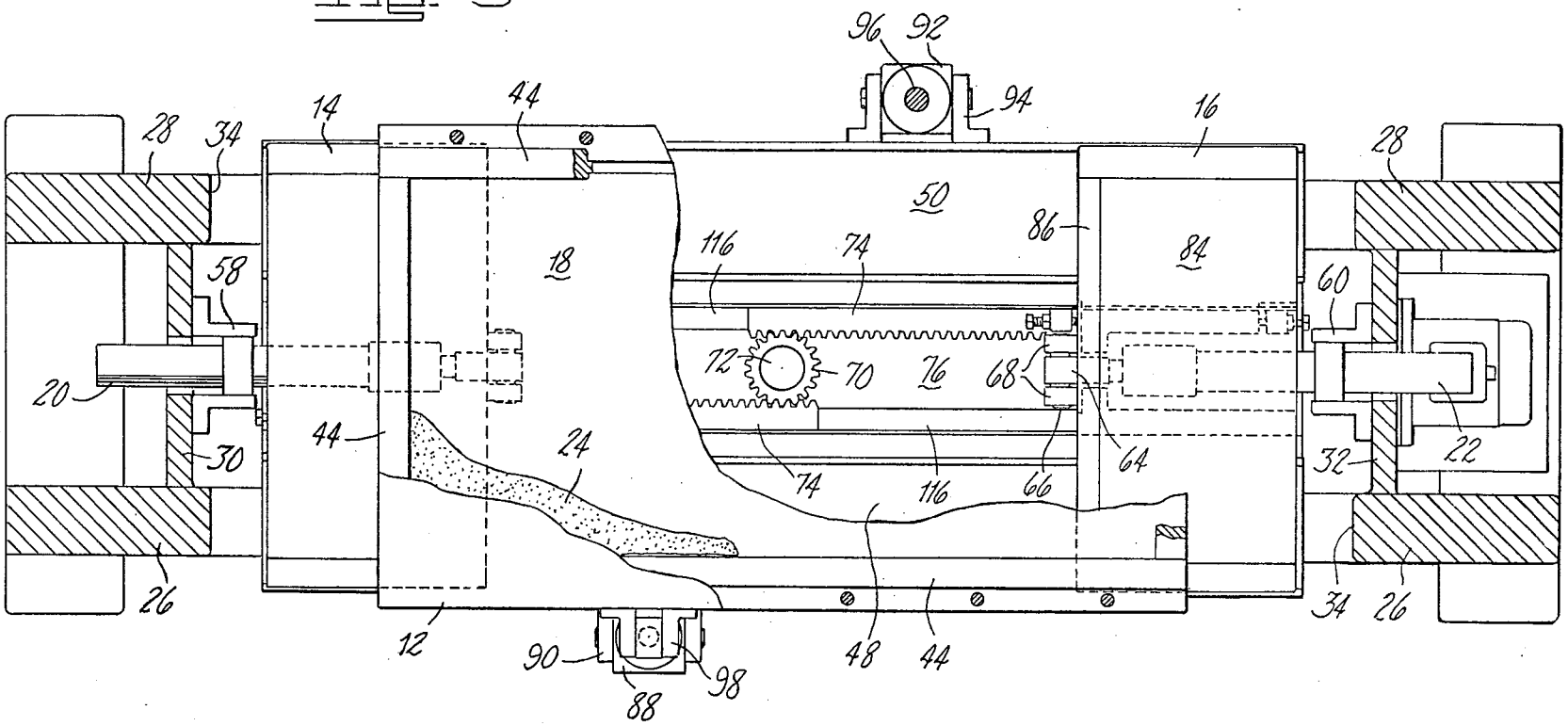
FIG. 3 is a plan view of the first embodiment of the press, in an open condition, most of a lower platen and bolster being cut away to reveal two synchronized wedge members mounted on a base member of the press.
Figure 4:
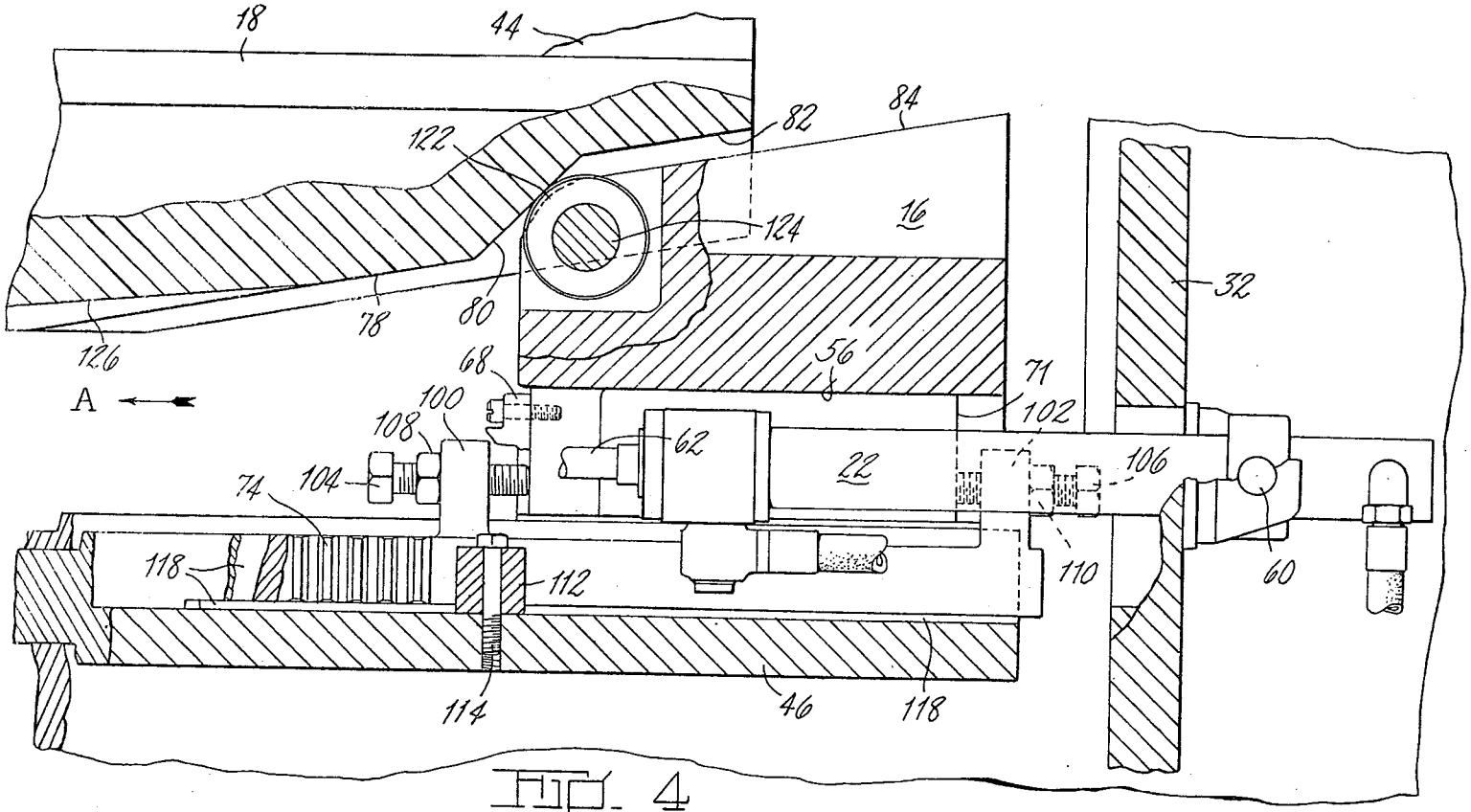
FIG. 4 is a sectional view in elevation from the front of a second embodiment of the press, showing engagement of a wedge member with a bolster of the press.

The two hydraulic cylinders, 20 and 22, are each mounted, as shown in FIGS. 1, 3 and 4, towards each side of the press outwardly of the wedge members. Both of the cylinders, 20 and 22, are aligned transversely of the press and are each mounted on a trunnion mounting, 58 and 60, which permit small pivotal movements of the cylinders about horizontal axes extending longitudinally of the press. A piston rod 62 extends from each of the cylinders, 20 and 22, towards the centerline of the press. Each piston rod 62 passes through the tunnel 56 between the front and rear foot portions of its associated wedge member, 14 or 16. A head block 64 is disposed at the distal end of each piston rod 62, and carries a pivot pin 66 which projects from each side of the block 64 longitudinally of the press. The projecting portions of each pin are pivotally received in two carrier blocks 68. The carrier blocks are secured to a machined surface 69 facing the centerline of the press. The hydraulic cylinders, 20 and 22, are thereby secured to the wedge members, 14 and 16 and are operable to drive them along the horizontal slideways of the base member 46.

One embodiment of the wedge synchronizing means comprises a toothed pinion wheel 70 which is mounted on the centerline of the press, midway between the front and rear slideways, 48 and 50, of the base member, for rotation about a vertical axis. The wheel 70 is rotatably mounted on a headed axle pin 72 in a channel 76 of the base member 46 between the slideways, 48 and 50. A straight toothed rack member 74 is secured to each of the wedge members, 14 and 16. The two rack members 74 are arranged to slide along opposite side walls of the channel 76 on diametrically opposite sides of the pinion wheel 70. The racks 74 and the pinion wheel 70 are engaged to permit the two wedge members, 14 and 16, to move synchronously. A scotch bar 116 is secured to the end of each rack member 74.

Each rack member 74, as shown in FIGS. 4 and 5, has two upstanding lugs. An inner lug 100 is disposed adjacent the machined face 69 of its associated wedge member and an outer lug 102 is disposed adjacent an outer machined face 71 of its associated wedge member. A pair of bolts, 104 and 106, are screwed through the lugs 100 and 102, respectively, to engage the machined faces, 69 and 71. A pair of lock nuts, 108 and 110, secure the rack member 74 in adjusted position relative to the wedge member. A pair of spacing blocks 112 (one each shown in FIGS. 4 and 5) are each secured by an arrangement of bolts 114 to the base member 46 in the channel 76. The spacing blocks 112 maintain the separation of the rack members 74. The spacing blocks 112 each extend between one of the rack members 74 and the scotch bar 116 secured to the end of the other rack. A pair of brass bearing strips 118 are provided to permit the free running of the rack members 74 against the base member 46 and the spacing blocks 112. Both of the rack members 74 being in simultaneous engagement with a common pivot gear 72 effectuating the synchronous movement in the wedges, 14 and 16.

Another more preferred embodiment of the wedge synchronizing means comprises a hydraulic balancing arrangement without the need for a pinion wheel, axle pin, or racks. The hydraulic balancing arrangement may comprise a flow divider in the pressurized hydraulic supply system or may be included with one of the double-acting cylinders 20 or 22, to provide synchronous movement between the two wedges, 14 and 16.

The bolster 18, and the lower platen 12, are supported by the wedge members, 14 and 16, on the base member 46. A bottom surface of the bolster 18 is machined to provide slidways extending transversely of the press parallel to the slideways, 48 and 50, of the base member 46, as shown in FIG. 2. The slideways permit sliding engagement with the wedge members, 14 and 16. The bolster slideways on each side of the centerline C comprise, as shown in FIGS. 1 and 4, an inner portion 78 at about 10° to the horizontal, a middle portion 80 may be disposed in a range of about 20° to about 45°, preferably 30° to the horizontal, and an outer portion 82 at 10° to the horizontal. Each of the wedge members, 14 and 16, has a primary flat bearing surface 84, at 10° to the horizontal. The wedge members of the first embodiment of the press as shown in FIG. 1, also have a secondary flat bearing surface 86 correspondingly disposed in a range of about 20° to about 45°, preferably 30° to the horizontal.

The wedge members, 14 and 16, of the second embodiment of the press as shown in FIGS. 4 and 5, each comprise two pairs of rollers, a front pair 120 and a rear pair 122 mounted for rotation about horizontal shafts 124, which take the place of the 30° secondary bearing surfaces 86 of the wedge members of the first embodiment of the press. In the second embodiment of the press, the bottom surface of the bolster 18 is additionally machined to provide runways 126 to receive the rollers 120 and 122. The runways 126 are channels machined out of the 10° inner portions 78 of the bolster slideways at 5° to the horizontal.

The first embodiment of the press (but not the second embodiment of the press) also comprises a front and a rear single-acting hydraulic lifting cylinder, 88 and 92, as shown in FIGS. 1 and 2, which are arranged to lift the bolster 16 vertically in cooperation with the wedge members, 14 and 16. The front cylinder 88 is mounted by a trunnion mounting 90 to a front face of the base member 46, and the rear cylinder 92 is mounted by a trunnion mounting 94 to a rear face of the base member 46. The lifting cylinders, 88 and 92, are spaced equally from, but to opposite sides of, the press centerline C. A piston rod 96 extends vertically upwards from each of the lifting cylinders, 88 and 92, and is pivotally secured about an upper pivot pin 98, to the bolster 18. Actuation of the lifting cylinders, 88 and 92, causes a lifting force to be applied to the bolster 18.

With the first embodiment of the press in its open condition the wedge members, 14 and 16, are in the positions shown in chain-dot lines in FIG. 1. The bolster 18 is shown resting on the wedge members, 14 and 16, with the outer portions 82 of the bolster slideways lying against the primary bearing surface 84 of the wedge members, and the middle portions 80 lying against the secondary bearing surfaces 86. The inflatable sac 24, is, in this condition of the press, deflated. The upper platen is heated to about 200° F.

A leather workpiece is placed on the upper work surface 40 of the lower platen 12 by an operator of the press. Hydraulic pressure is then admitted to the two lifting cylinders, 88 and 92, and to the wedge driving cylinders, 20 and 22. The bolster 18 is thereby lifted vertically and the wedge members, 14 and 16, are driven horizontally inwardly towards the centerline of the press. Lifting of the bolster 18 continues until the workpiece is clamped between the upper work surface 40 of the lower platen 12 and the work surface 38 of the upper platen 10. The wedge members, 14 and 16, are at this time in the positions shown by the solid lines in FIG. 1 and urged inwardly by the cylinders, 20 and 22, to exert a clamping pressure on the workpiece. After the workpiece has been clamped, pressure is caused to build up in the hydraulic system to operate a switch which causes hydraulic fluid to be admitted to the inflatable sac 24. A pressure of about 1350 p.s.i. is admitted to the sac 24 to apply the required pressure to the leather workpiece between the platens 10 and 12. The lower platen 12 is thereby lifted a small distance guided by the support strips 44. The sac 24 is arranged to increase in depth from about 30 mm when uninflated, to about 36 mm when pressurized to about 1350 p.s.i.

After the workpiece has been held under pessure for a required time, the sac 24 and the lifting cylinders 88 and 92, are depressurized and the cylinders 20 and 22, are actuated to withdraw the wedge members, 14 and 16, and lower the bolster 18. The springs 128 serve to deflate the sac 24 and ensure that the lower platen is returned to its seating of the support strips 44. The operator can remove the workpiece when the press has returned to its open condition.

Operation of the second embodiment of the press is very similar to that of the first embodiment of the press except that the bolster 18 is lifted from an open condition of the press solely by the action of the wedge driving cylinders 20 and 22. The two pairs of rollers 120 and 122, enable the bolster 18 to be lifted by the wedge members, 14 and 16, without the need for lifting cylinders as in the first embodiment of the press. When the rollers, 120 and 122, have ridden onto the inner portions 78 of the bolster slideways they then progress into the runways 126. The primary bearing surfaces 84 of the wedge members, 14 and 16, come into sliding contact with the inner portions 78 of the bolster slideways, enabling the load of the bolster 18 to be taken solely on the bearing surfaces 84 of the wedge members by the time clamping pressure is applied to a workpiece and the sac 24 is inflated.

In the two embodiments of the presses, the inclination of the inner and outer slideway portions, 78 and 82, of the bolster 18 (and correspondingly of the primary bearing surfaces 84 of the wedge members, 14 and 16) is such that the wedge members, 14 and 16, are self-locking against the bolster 18, and no supplementary locking mechanism is needed to prevent outwards movement when a full load is exerted on the wedge members, 14 and 16, by pressurization of the sac 24. The steeply inclined middle portion 80 of the bolster slideways is provided to shorten the distance that the wedge members have to be moved to provide for an adequate clearance between the platens 10 and 12, when the press in in its open condition.

Having thus described our invention, what we claim as new, and desire to secure as Letters Patent of the United States is:

1. A machine for effecting an operation on an article, said machine comprising:

a first platen and a second platen mounted in a frame of said machine;

a first closing means for urging movement of the first and second platens relative to one another, said article being disposed therebetween; and a second closing means for applying a predetermined pressure on said article disposed between said first and second platens;

said first closing means comprising at least two wedge members having sloped surfaces in sliding engagement with a supporting surface of at least one of said platens, and wedge driving means to synchronously cause said movement of said wedge members.

2. A machine for effecting an operation on an article as recited in claim 1, wherein said first platen is a generally horizontally disposed lower platen, and said second platen is a generally horizontally disposed upper platen.

3. A machine for effecting an operation on an article as recited in claim 1, wherein said wedge driving means comprises at least one pressure regulatable cylinder arranged between each wedge member and the frame of said machine to effect movement of said wedge members.

4. A machine for effecting an operation on an article as recited in claim 3, wherein said wedge members and the support surface of said first platen have correspondingly sloped surfaces which slidingly mate with one another to effect the relative movement of said first platen with respect to said second platen, when said pressure regulatable cylinders are actuated.

5. A machine for effecting an operation on an article as recited in claim 3, wherein each of said wedge members has an arrangement of rollers secured thereto, said rollers acting upon a sloped supporting surface of said first platen to effect the relative movement of said first platen with respect to said second platen, when said pressure regulatable cylinders are actuated.

6. A machine for effecting an operation on an article, as recited in claim 4, wherein the slope between said corresponding surfaces of said wedge members and said first platen is such as to prevent slippage therebetween when a load is placed on said first platen.

7. A machine for effecting an operation on an article, said machine comprising:

a first platen and a second platen mounted in a frame of said machine;

a first closing means for urging movement of the first and second platens relative to one another, said article being disposed therebetween; and a second closing means for applying a predetermined pressure on said article disposed between said first and second platens;

said first closing means comprising at least two wedge members having sloped surfaces in sliding engagement with at least one of said platens, and driving means to synchronously cause said movement of said wedge members;

said second closing means comprising at least one pressurizable member arranged with one of said platens to press said article against the other of said platens with the predetermined pressure to effect the operation thereon.

8. A machine for effecting an operation on an article, as recited in claim 7, wherein said first platen is a generally horizontally disposed lower platen, and said second platen is a generally horizontally disposed upper platen.

9. A machine for effecting an operation on an article as recited in claim 7, wherein said driving means includes a pressurizable cylinder arranged between each of said wedges and said frame, and a rack with teeth thereon extending from each wedge to opposite sides of a common pivot gear, motion therewith effecting only synchronous movement therebetween.

10. A machine for effecting an operation on an article as recited in claim 7, wherein said driving means comprises a pressurizable cylinder arranged between each of said wedges and said frame, said cylinders being hydraulically balanced with one another by means of a flow divider arranged within the pressurized hydraulic fluid supply line, to permit synchronous movement between each of the wedges.

11. A machine for effecting an operation on an article as recited in claim 7, wherein said one pressurizable member of said second closing means comprises an inflatable sac capable of causing a pressure gradient over generally the entire area of the platen.

12. A machine for effecting an operation on an article as recited in claim 11, wherein said inflatable sac is disposed in the lower platen.

* * * * *